US007921823B2

(12) United States Patent
Sailer et al.

(10) Patent No.: US 7,921,823 B2
(45) Date of Patent: Apr. 12, 2011

(54) HYDRAULIC PLAY COMPENSATION DEVICE

(75) Inventors: Peter Sailer, Erlangen (DE); Oliver Schnell, Veitsbronn (DE); Dieter Schmidt, Nuernberg (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/551,894

(22) Filed: Oct. 23, 2006

(65) Prior Publication Data

US 2007/0044746 A1 Mar. 1, 2007

Related U.S. Application Data

(63) Continuation of application No. PCT/EP2005/004390, filed on Apr. 23, 2005.

(60) Provisional application No. 60/586,140, filed on Jul. 7, 2004.

(30) Foreign Application Priority Data

May 13, 2004 (DE) ..... 10 2004 023 599

(51) Int. Cl.
*F01L 1/14* (2006.01)

(52) U.S. Cl. ..... 123/90.55; 123/90.48; 123/90.52; 123/90.16

(58) Field of Classification Search ..... 123/90.55, 123/90.48, 90.16, 90.57, 90.58, 90.52, 90.49
See application file for complete search history.

(56) References Cited

U.S. PATENT DOCUMENTS

| | | | | |
|---|---|---|---|---|
| 2,676,579 A | | 4/1954 | Gerner | |
| 3,304,925 A | | 2/1967 | Rhoads | |
| 4,457,270 A | | 7/1984 | Kodama et al. | |
| 4,463,714 A | * | 8/1984 | Nakamura | 123/90.57 |
| 6,247,433 B1 | | 6/2001 | Faria et al. | |
| 6,513,470 B1 | | 2/2003 | Hendriksma et al. | |
| 6,578,535 B2 | | 6/2003 | Spath et al. | |
| 6,595,174 B2 | | 7/2003 | Schnell | |
| 6,606,972 B2 | | 8/2003 | Wenisch et al. | |
| 6,988,474 B2 | | 1/2006 | Itoafa | |
| 7,117,833 B2 | | 10/2006 | Spath et al. | 123/90.55 |
| 7,464,680 B2 | | 12/2008 | Geyer et al. | |

FOREIGN PATENT DOCUMENTS

| | | |
|---|---|---|
| DE | 24 34 831 A | 1/1976 |
| DE | 41 03 055 A | 8/1992 |
| DE | 199 49 497 A | 4/2001 |
| DE | 102 04 672 A1 | 8/2003 |
| DE | 100 46 323 A | 2/2004 |
| EP | 0 552 369 Y | 7/1993 |
| JP | 57-163106 | 10/1982 |
| JP | 57163106 A | 10/2006 |
| WO | 03/067038 A1 | 8/2003 |

OTHER PUBLICATIONS

Representation of socket plunger of lifter involved in testing by early 2003 in Mexico, and tested during or about Oct. 2002 to Jan. 2003 in Germany, 1 sheet.

(Continued)

*Primary Examiner* — Zelalem Eshete
(74) *Attorney, Agent, or Firm* — Fitzpatrick, Cella, Harper & Scinto

(57) ABSTRACT

The hydraulic play compensation device, having an outer cylinder part which is closed on one side by a base and in which a piston element which lies on its inside is guided so as to be longitudinally displaceable, with a guide gap, having an oil pressure space having an oil inlet which supplies the oil supply space, and having a connecting duct controlled by a nonreturn valve between the oil supply space and the oil pressure space. For optimized removal of air which is introduced via the oil inlet, it is proposed that a ventilation path which connects the oil supply space and the guide gap is formed in the piston element downstream of the oil inlet and upstream of the connecting duct.

13 Claims, 2 Drawing Sheets

OTHER PUBLICATIONS

DCX 5.7L Lifter Guide Assembly, SEP Cold Start Noise Solutions—Agenda, (or or about) Nov. 2002, 5 sheets.
INA-Schaeffler KG, "DaimlerChrysler 5.7L Technical Review", (on or about) Jan. 30, 2003, 8 sheets.
DaimlerChrysler/INA Engine Programs, 4.7L and 5.7L Discussion (on or about) Jan. 14, 2003, 7 sheets.

Drawing EDD F-46702.18 000 © 2002, 1 sheet.

* cited by examiner

HYDRAULIC PLAY COMPENSATION DEVICE

This application is a continuation of International Application No. PCT/EP2005/004390 filed Apr. 23, 2005, which in turn claimed the priority of German Patent Application 10 2004 023 599.6 filed May 13, 2004 and U.S. Provisional Application No. 60/586,140 filed Jul. 7, 2004. the priority of all three applications is hereby claimed and all three applications are incorporated herein by reference.

DESCRIPTION

1. Field of the Invention

The invention relates to a hydraulic play compensation device, in particular for use in internal combustion engines, preferably in valve timing mechanisms and belt drives or chain drives, in accordance with the preamble of patent claim 1.

2. Background of the Invention

Hydraulic play compensation devices are coupling elements between two machine elements which change their relative play with respect to one another during operation. The abovementioned hydraulic play compensation devices serve to compensate for this undesirable play and comprise at least two components which can be displaced with respect to one another by hydraulic pressure. The abovementioned machine elements can be, for example, a gas exchange valve and a component of a reciprocating piston internal combustion engine which actuates said gas exchange valve. They are likewise used in a camshaft drive or auxiliary assembly drive as an adjuster, the two machine elements being a stationary base and, for example, a shoe which acts on a chain.

Air which is contained in the supplied oil or which penetrates into the device in some other way and passes into its high pressure part is a problem for the operation of such play compensation devices. This leads to a partial or total loss of the play compensation properties, which can have disadvantageous consequences for the machine elements in question. This problem can be exacerbated by unfavorable installation positions, for example by an arrangement which tends toward horizontal fitting.

U.S. Pat. No. 3,304,925 which forms the generic type has disclosed a hydraulic play compensation device in the valve timing mechanism of an internal combustion engine, having an outer cylinder part which is closed on one side by a base and in which a piston element which lies on its inside is guided so as to be longitudinally displaceable, with a guide gap which is necessary for its functioning being left, having an oil pressure space which is formed between said base and the piston element, and having an oil supply space which is formed within the piston element. In addition, said play compensation device is equipped with an oil inlet which supplies the oil supply space and with a connecting duct controlled by a nonreturn valve between the oil supply space and the oil pressure space. In order to avoid impermissibly high hydraulic pressures, this known device has, in the interface between the cylinder part and the piston element, a flattened portion which limits the pressure and permits an oil leakage flow.

U.S. Pat. No. 4,688,525 has disclosed a hydraulic valve clearance compensation element (HVCCE) which is integrated into a cup tappet of a gas exchange valve timing mechanism. A potlike ventilation element is arranged between a cup base and the HVCCE in a comparatively complicated manner in order to deair the oil. The pot base of said potlike ventilation element faces the cup base, while the open side partially surrounds the HVCCE. As a result, an oil inlet flow is produced in a similar manner to a labyrinth, the result of which is an increased deairing duration. The air bubbles which are expelled in the process are led away via a plurality of ventilation hole or ventilation ducts in the pot base and cup base. The longitudinally displaceable piston element of the HVCCE is in contact with that side of the pot base which faces the HVCCE, a plurality of notches serving to feed in oil from outside into the HVCCE and to lead air bubbles out.

For the removal of air enclosed in the high pressure space of an HVCCE, it is known from DE 41 03 055 A1 to arrange longitudinal grooves which extend over an axially limited length in the gap which remains between the cylinder part and the piston element.

EP 0 552 369 A1 proposes, for removing air enclosed in a blind hole of a cylinder head when an HVCCE is fitted into said blind hole, the provision of a spirally extending ventilation groove on the outer circumference of the cylinder part outer surface which faces the blind hole.

OBJECT OF THE INVENTION

The invention is based on the object of specifying a hydraulic play compensation device which avoids the ingress of air into the oil pressure space to a very great extent or completely, in a comparatively simple manner.

This object is achieved with the features of patent claim 1. Advantageous refinements of the invention are specified in the dependent claims.

SUMMARY OF THE INVENTION

The invention is based on the finding that the ingress of air into the oil pressure space, which is damaging for the operation of a hydraulic play compensation device, can be avoided reliably or reduced considerably, with reduced complexity, if it is possible to carry out deairing in the oil volume before it enters the oil pressure space, with widespread utilization of paths which are already present.

The object set is achieved by a hydraulic play compensation device, having an outer cylinder part which is closed on one side by a base and in which a piston element which lies on its inside is guided so as to be longitudinally displaceable, with a guide gap which is necessary for its functioning being left, having an oil pressure space which is formed between said base and the piston element, having an oil supply space which is formed within the piston element, having an oil inlet which supplies the oil supply space, and having a connecting duct controlled by a nonreturn valve between the oil supply space and the oil pressure space, a ventilation path which connects the oil supply space and the guide gap being formed in the piston element downstream of the oil inlet and upstream of the connecting duct.

This construction has the advantage that, by using the leakage oil path which is present between the cylinder part and the piston element by means of a connection between the oil supply space and the guide gap which forms the leakage oil path, reliable air removal is ensured before said air can pass into the oil pressure space having overcome the connecting duct.

It is preferred here for the piston element to have a substantially hollow cylindrical piston skirt in the region between the oil supply space and the cylinder part, and for the ventilation path to be formed in said piston skirt. Said piston skirt is suitable for the arrangement of the ventilation path on account of its cylindrical design.

Here, the ventilation path itself is preferably configured in the form of a ventilation duct which in turn is preferably arranged so as to extend substantially radially. This makes it possible to reduce the flow resistance in the ventilation path in such a way that the air bubbles pass into the leakage gap along a comparatively short path.

For optimization between improved air removal on the one hand and as high a resistance as possible to leakage oil losses via the ventilation path on the other hand, there is preferably provision for the at least one ventilation duct to be configured so as to extend in the manner of a labyrinth.

For further optimization with regard to insensitivity to critical installation positions, it can be preferred to provide a plurality of ventilation ducts which open into the guide gap in the piston skirt distributed around its circumference. Reliable removal of air upward is thus always ensured in the case of oblique or horizontal installation.

As a result of the fact that the ventilation path is arranged in the flow path between the oil inlet and the connecting duct relatively closer to the oil inlet and correspondingly relatively spaced apart from the connecting duct, it can be achieved in an advantageous refinement that the oil pressure loss via the ventilation path is less than that which occurs in the guide gap on the oil path between the oil pressure space and the opening of the ventilation ducts into said guide gap.

A suction effect on the remaining part of the leakage gap path by that part of said leakage gap path which lies between the oil inlet and the opening of the ventilation path into the guide gap is thus avoided, which could otherwise lead to an increased leakage oil flow out of the oil pressure space. An arrangement which is as closely adjacent to the oil inlet as possible is therefore preferred.

For further optimization with regard to the pressure and flow conditions, there is preferably provision for the guide gap to have a width between 0.003 mm and 0.15 mm, preferably between 0.005 mm and 0.1 mm. In a further refinement, the ventilation duct has a width and/or depth between 0.003 mm and 0.3 mm, preferably between 0.005 mm and 0.175 mm. It is possible here, as a function of the diameter of the piston element, to set in each case an optimum compromise with regard to maximum air removal and minimized oil loss.

The minimized oil loss advantageously avoids leaks from the play compensation device during a down time phase. Overall, it is possible to find an optimum combination of the number of ventilation ducts and their length in conjunction with their cross section.

For further optimization with regard to the configuration of the ventilation path, it can be preferred for the piston element to be formed from a piston lower part facing the oil pressure space and a piston upper part facing the oil inlet, and for the ventilation path to be arranged in the dividing plane between the piston upper part and the piston lower part. This has the advantage that the configuration of the ventilation ducts is made substantially simpler, as they are then delimited by the two end faces which face one another.

Here, there can be provision for one of the two end faces to be flat, while the other, being contoured, for example in the form of grooves extending in a labyrinthine or meandering manner, represents the other part of the ventilation duct.

As an alternative to this, that part of the ventilation duct which lies in the contoured end can also be configured as a circumferential spiral groove which offers at least a comparatively high resistance to oil loss.

It is preferred here for said spiral grooves to be between a minimum of 0.003 mm and a maximum of 0.3 mm deep, preferably between 0.005 mm and 0.175 mm. Given an optimized design of said spiral groove depth and their cross-sectional area, there is great freedom in the selection of the width of the guide gap between the cylinder part and the piston upper part.

In principle, the labyrinth grooves can be formed in one of the two end faces which face one another, but combinations are also conceivable. Particularly good results have been obtained, for example, with a labyrinth groove width of approximately 0.3 mm and 5 as the number of labyrinth grooves, 4 as the number of labyrinth grooves also having supplied good results in the case of a smaller piston element diameter.

The invention can be used in a large number of different applications, independently of special requirements, such as in valve timing mechanisms in HVCCEs, in valve timing mechanisms equipped with tappet push rods, or in chain or belt adjusters of, for example, auxiliary assembly drives.

BRIEF DESCRIPTION OF THE DRAWINGS

The invention will be explained in greater detail in the following text using the appended drawings of an exemplary embodiment. In the drawings.

DETAILED DESCRIPTION OF THE DRAWINGS

Figure 1:
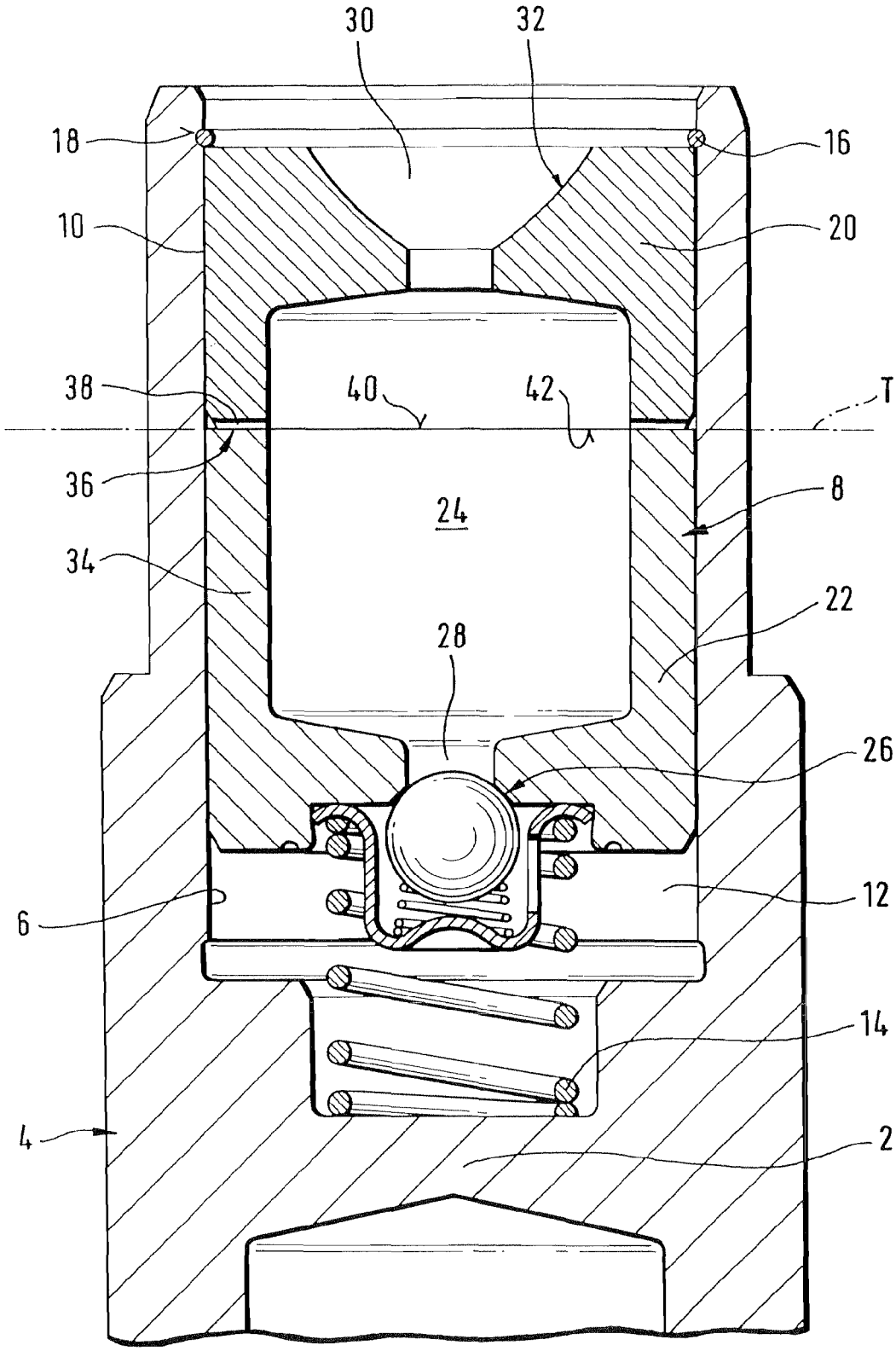
FIG. 1 shows a cross section through a hydraulic play compensation device.
Figure 2:
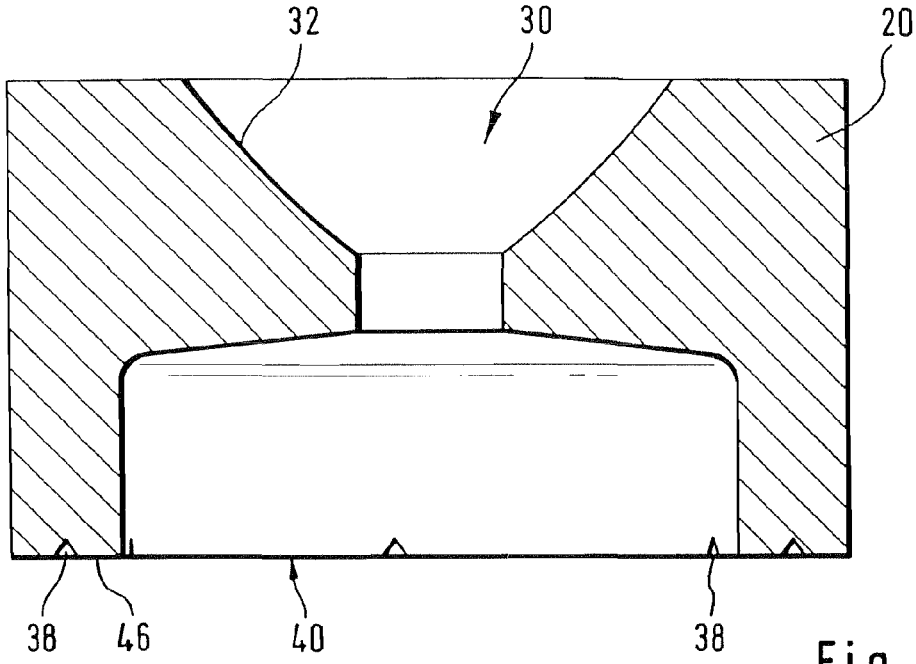
FIG. 2 shows a cross section through an embodiment of a piston upper part according to FIG. 1.

According to FIG. 1, a hydraulic play compensation device which is used in a valve timing mechanism (not shown) of an internal combustion engine has a cylinder part 4 which is closed by a base 2. The outer contour of said cylinder part 4 is inserted into a housing (not shown) of the internal combustion engine, the base 2 being operatively connected to a gas exchange valve. A longitudinally displaceable piston element 8 which lies on the inside with respect to the cylinder part 4 is inserted into a hollow cylindrical receptacle 6, with a guide gap 10 which is necessary for its functioning being left, said guide gap 10 having a width in the range from 0.005 mm to 0.1 mm.

A compression spring 14 is inserted into an oil pressure space 12 between the base 2 and the piston element 8 in such a way that the piston element 8 at most comes into contact with a securing ring 16 which acts as a stop and is inserted into a groove 18 of the piston element 8.

An oil supply space 24 is formed in the interior of the piston element 8 which is formed from a piston upper part 20 and a piston lower part 22, which oil supply space 24 can be flow connected to the oil pressure space 12 via a connecting duct 28 controlled by a nonreturn valve 26.

The piston upper part 20 has a feed cone 32 as part of an oil inlet 30, said piston upper part 20 being acted on on its side facing away from the oil supply space 24 by a tappet push rod (not shown) and being supplied with oil.

The two parts of the piston element 8, the piston upper part 20 and the piston lower part 22, adjoin one another in a dividing plane T which is arranged in the region of a hollow cylindrical piston skirt 34. Lying in said dividing plane T, a ventilation path 36 which connects the oil supply space 24 to the guide gap 10 is formed downstream of the oil inlet 30 and upstream of the connecting duct 28.

Said ventilation path 36 has a plurality of substantially radially extending ventilation ducts 38 which are arranged in the piston skirt 34 distributed around its circumference. In the event of a rectilinear or curved profile, the ventilation ducts 38 preferably have a width and/or depth in the order of magnitude of from 0.005 mm to 0.3 mm.

The piston upper part 20 and the piston lower part 22 each adjoin the dividing plane T with one of their ends 40 and 42. While the end 42 of the piston lower part 22 is ground flat in this exemplary embodiment, the end 40 of the piston upper part 20 is contoured in such a way that the ventilation ducts are formed and delimited on one side by the corresponding flat part and on the other side by grooves 38 which extend in the manner of a labyrinth (FIG. 3).

Figure 3:
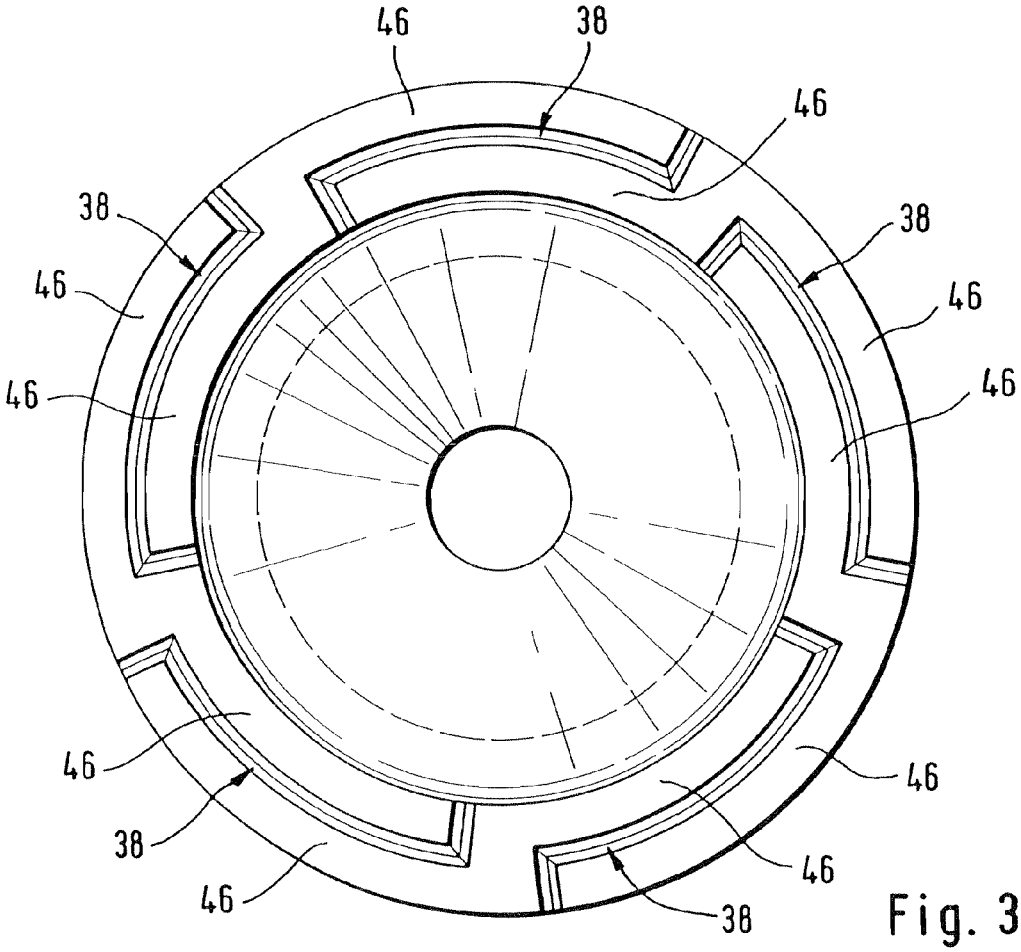
FIG. 3 shows a plan view of the end of the piston upper part according to FIG. 2.

Here, according to FIG. 3, the contoured end 40 has grooves 38 which extend in a meandering shape and between which raised guide walls 46 are arranged. Here, the grooves 38 consist in each case of a collecting path which accommodates gas and oil, an oil passage and an outflow path. In this configuration, the grooves 38 have a width of approximately 0.3 mm and a depth of approximately 0.005 mm to 0.3 mm, along the individual sections transversely with respect to the direction of flow.

As an alternative, the ventilation duct 38 of the ventilation path can be configured as a spirally extending, channel like groove, the depth of which lies in the range from 0.005 mm to 0.3 mm.

More specifically, the invention maybe defined as follows by reference to the list of designations:

1. A hydraulic play compensation device, in particular for use in internal combustion engines, preferably in valve timing mechanisms and belt drives or chain drives, having an outer cylinder part (6) which is closed on one side by a base (2) and in which a piston element (8) which lies on its inside is guided so as to be longitudinally displaceable, with a guide gap (10) which is necessary for its functioning being left, having an oil pressure space (12) which is formed between said base (2) and the piston element (8), having an oil supply space (24) which is formed within the piston element (8), having an oil inlet (30) which supplies the oil supply space (24), and having a connecting duct (28) controlled by a nonreturn valve (26) between the oil supply space (24) and the oil pressure space (12), wherein a ventilation path (36) which connects the oil supply space (24) and the guide gap (10) is formed in the piston element (8) downstream of the oil inlet (30) and upstream of the connecting duct (28).
2. The play compensation device as recited in item 1, wherein the piston element (8) has a substantially hollow cylindrical piston skirt (34) in the region between the oil supply space (24) and the cylinder part (4), and the ventilation path (36) is formed in said piston skirt (34).
3. The play compensation device as recited in item 2, wherein the ventilation path (36) comprises at least one ventilation duct (38).
4. The play compensation device as recited in item 3, wherein the ventilation duct (38) is arranged so as to extend substantially radially.
5. The play compensation device as recited in item 3 or 4, wherein the ventilation duct (38) is configured so as to extend in the manner of a labyrinth.
6. The play compensation device as recited in at least one of items 3 to 5, wherein a plurality of ventilation ducts (38) which open into the guide gap (10) are arranged in the piston skirt (34) distributed around its circumference.
7. The play compensation device as recited in one or more of the items, wherein the ventilation path (38) is arranged in the flow path between the oil inlet (30) and the connecting duct (28) relatively closer to the oil inlet (30) and correspondingly relatively spaced apart from the connecting duct (28).
8. The play compensation device as recited in one or more of the preceding items, wherein the guide gap (10) has a width between 0.003 mm and 0.15 mm, preferably between 0.005 mm and 0.1 mm.
9. The play compensation device as recited in one or more of the preceding items 3 to 8, wherein the ventilation duct (38) has a width and/or depth between 0.003 mm and 0.3 mm, preferably between 0.005 mm and 0.175 mm.
10. The play compensation device as recited in one or more of the preceding items, wherein the piston element (8) is formed from a piston lower part (22) facing the oil pressure space (12) and a piston upper part (20) facing the oil inlet (30), and the ventilation path (36) is arranged in the dividing plane (T) between the piston upper part (20) and the piston lower part (22).
11. The play compensation device as recited in item 10, wherein the piston upper part (20) and the piston lower part (22) each adjoin the dividing plane (T) with their end (40 and 42, respectively), and the ventilation path (36) is delimited by a flat end (40 or 42) and a contoured end (42 or 40).
12. The play compensation device as recited in item 11, wherein the contoured end (42 or 40) has ventilation ducts (38) which extend in the manner of a labyrinth.
13. The play compensation device as recited in item 11, wherein the contoured end (42 or 40) has at least one spirally extending ventilation path (36) or ventilation duct (38).

The invention may also be summarized as follows:

The invention relates to a hydraulic play compensation device, in particular for use in internal combustion engines, preferably in valve timing mechanisms and belt drives or chain drives, having an outer cylinder part (6) which is closed on one side by a base (2) and in which a piston element (8) which lies on its inside is guided so as to be longitudinally displaceable, with a guide gap (10) which is necessary for its functioning being left, having an oil pressure space (12) which is formed between said base (2) and the piston element (8), having an oil supply space (24) which is formed within the piston element (8), having an oil inlet (30) which supplies the oil supply space (24), and having a connecting duct (28) controlled by a nonreturn valve (26) between the oil supply space (24) and the oil pressure space (12).

For optimized removal of air which is introduced via the oil inlet (30), it is proposed that a ventilation path (36) which connects the oil supply space (24) and the guide gap (10) is formed in the piston element (8) downstream of the oil inlet (30) and upstream of the connecting duct (28).

LIST OF DESIGNATIONS

2 Base
4 Cylinder part
6 Receptacle
8 Piston element
10 Guide gap
12 Oil pressure space
14 Compression spring
16 Securing ring
18 Groove
20 Piston upper part
22 Piston lower part
24 Oil supply space
26 Nonreturn valve

28 Connecting duct
30 Oil inlet
32 Feed cone
34 Piston skirt
36 Ventilation path
38 Groove, ventilation duct
40 End
42 End
46 Guide wall
T Dividing plane

The invention claimed is:

1. A hydraulic play compensation device, comprising an outer cylinder part which is closed on one side by a base and in which a piston element which lies on its inside is guided so as to be longitudinally displaceable, with a guide gap which is necessary for its functioning being left, having an oil pressure space which is formed between said base and the piston element, having an oil supply space which is formed within the piston element, having an oil inlet which supplies the oil supply space and which does not intersect the guide gap, and having a connecting duct controlled by a nonreturn valve between the oil supply space and the oil pressure space, wherein a ventilation path which connects the oil supply space and the guide gap in every longitudinal position of the piston element, is formed in the piston element downstream of the oil inlet and upstream of the connecting duct.

2. The play compensation device as claimed in claim 1, wherein the piston element has a substantially hollow cylindrical piston skirt in the region between the oil supply space and the cylinder part, and the ventilation path is formed in said piston skirt.

3. The play compensation device as claimed in claim 1, wherein the ventilation path is arranged in the flow path between the oil inlet and the connecting duct relatively closer to the oil inlet and correspondingly relatively spaced apart from the connecting duct.

4. The play compensation device as claimed in claim 1, wherein the guide gap has a width between 0.003 mm and 0.15 mm, preferably between 0.005 mm and 0.1 mm.

5. The play compensation device as claimed in claim 1, wherein the piston element is formed from a piston lower part facing the oil pressure space and a piston upper part facing the oil inlet, and the ventilation path is arranged in the dividing plane between the piston upper part and the piston lower part.

6. The play compensation device as claimed in claim 5, wherein the piston upper part and the piston lower part each adjoin the dividing plane with their end, and the ventilation path is delimited by a flat end and a contoured end.

7. The play compensation device as claimed in claim 6, wherein the contoured end has ventilation ducts which extend in the manner of a labyrinth.

8. The play compensation device as claimed in claim 6, wherein the contoured end has at least one spirally extending ventilation path or ventilation duct.

9. A hydraulic play compensation device, comprising an outer cylinder part which is closed on one side by a base and in which a piston element which lies on its inside is guided so as to be longitudinally displaceable, with a guide gap which is necessary for its functioning being left, having an oil pressure space which is formed between said base and the piston element, having an oil supply space which is formed within the piston element, having an oil inlet which supplies the oil supply space, and having a connecting duct controlled by a nonreturn valve between the oil supply space and the oil pressure space, wherein a ventilation path which connects the oil supply space and the guide gap is formed in the piston element downstream of the oil inlet and upstream of the connecting duct, wherein the ventilation path comprises at least one ventilation duct.

10. The play compensation device as claimed in claim 9, wherein the ventilation duct is arranged so as to extend substantially radially.

11. The play compensation device as claimed in claim 9, wherein the ventilation duct is configured so as to extend in the manner of a labyrinth.

12. The play compensation device as claimed in claim 9, wherein a plurality of ventilation ducts which open into the guide gap are arranged in the piston skirt distributed around its circumference.

13. The play compensation device as claimed in claim 9, wherein the ventilation duct has a width and/or depth between 0.003 mm and 0.3 mm, preferably between 0.005 mm and 0.175 mm.

* * * * *